US006236824B1

(12) United States Patent
Pardubitzki

(10) Patent No.: US 6,236,824 B1
(45) Date of Patent: May 22, 2001

(54) SHUTTER ARRANGEMENT FOR ACCESS TO A PAPER PATH OF A SINGLE SHEET PRINTER OR COPIER

(75) Inventor: Richard Pardubitzki, Munich (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/284,821

(22) PCT Filed: Oct. 22, 1997

(86) PCT No.: PCT/DE97/02467

§ 371 Date: Jun. 17, 1999

§ 102(e) Date: Jun. 17, 1999

(87) PCT Pub. No.: WO98/18055

PCT Pub. Date: Apr. 30, 1998

(30) Foreign Application Priority Data

Oct. 22, 1996 (DE) ..... 196 43 636

(51) Int. Cl.[7] ..... G03G 15/00
(52) U.S. Cl. ..... 399/124; 271/273
(58) Field of Search ..... 399/124, 16, 19, 399/21, 125; 271/273

(56) References Cited

U.S. PATENT DOCUMENTS

| | | | | |
|---|---|---|---|---|
| 4,116,556 | | 9/1978 | Tanaka et al. | 399/121 |
| 4,386,845 | | 6/1983 | Miyoshi et al. | 399/21 |
| 4,478,506 | | 10/1984 | Miyoshi et al. | 399/317 |
| 5,122,841 | * | 6/1992 | Sasaki | 399/124 |
| 5,708,946 | * | 1/1998 | Cahill et al. | 399/323 |
| 6,145,828 | * | 11/2000 | Arai | 399/124 X |

FOREIGN PATENT DOCUMENTS 9-236995 * 9/1997 (JP) .

OTHER PUBLICATIONS

Patent Abstracts of Japan Application No. 56–36559 filed Mar. 16, 1981.
Patent Abstracts of Japan Application No. 58088467 filed May 20, 1983.
Patent Abstracts of Japan Application No. 58210621 filed Nov. 9, 1983.
Patent Abstracts of Japan Application No. 04135053 filed May 27, 1992.

* cited by examiner

*Primary Examiner*—Sophia S. Chen
(74) *Attorney, Agent, or Firm*—Schiff Hardin & Waite

(57) ABSTRACT

A shutter device enables access to the paper path in a single sheet printer with a first shutter (P1) which can pivot about a first pivotal axis (D2) into an open position wherein shutter stands at a distance from the paper path and uncovers an opening. A second shutter (P2) is located near the first shutter (P1). Like the first shutter, the second shutter forms, when in an operating position, a second of the guide surfaces adjacent to the section formed by the first shutter (P1), which can pivot about a second pivotal axis (D1) into an open position and increase an opening for access to the paper path when in this position. In order to support opening of the second shutter (P2), a clamping member (Z1) is also provided on the second shutter, which is prestressed when the second shutter (P2) is in the operating position.

20 Claims, 6 Drawing Sheets

SHUTTER ARRANGEMENT FOR ACCESS TO A PAPER PATH OF A SINGLE SHEET PRINTER OR COPIER

FIELD OF THE INVENTION

The invention is directed to a shutter arrangement for access to a paper path of single sheet printers and copiers.

BACKGROUND OF THE INVENTION

Paper jams occasionally occur in the paper path of single sheet printers and copiers. In any case, the paper path must be at least partially uncovered in order to remove jammed sheets. For the sake of simplicity, only single sheet printers shall be mentioned below instead of single sheet printers and copiers; not only paper but also other printing matter can be processed with single sheet printers, whereby only paper jam, paper material and the like shall be mentioned below.

In order to remove jammed sheets from the paper path, it is known, for example, to arrange shutters along the paper path that form a part of the guide surface of the paper path in the closed condition and that can be pivoted away from the paper path in the case of a paper jam so that the user can remove the jammed sheets.

U.S. Pat. No. 4,116,556, thus, discloses a copier device wherein a shutter arrangement is provided for removing potential paper jams in the area of the photo conductor drum. The shutter arrangement is composed of two shutters connected to one another via an articulation, the one thereof being seated at the housing of the copier device pivotable around a swivelling axis. The two shutters can be adjusted in common between an operating position wherein they form a guide surface for the paper path and an open position wherein the shutters are swivelled away from the paper path and release a lateral interspace between the paper path and the shutters through which the jammed sheets can be removed. A comparable shutter arrangement having two shutters pivotably seated at the housing is also disclosed by U.S. Pat. No. 4,478,506 or, respectively, by JP-57 151 954 A.

Given these known shutter arrangements, the shutters can in fact be swivelled away from the paper path in order to enable access into the paper path. The interspace between the paper path and the shutters produced for the access, however, is comparatively small due to the small structural volume of such copier devices, so that the jammed sheets can only be removed from the paper path under more difficult conditions and with a great expenditure of time.

Therefore, there is a need for a shutter arrangement for single sheet printers and copiers that can be unproblematically opened and enables simple access to the paper path.

SUMMARY OF THE INVENTION

In an embodiment, the shutters swivelled into the open position release an opening for the access, and in that at least one tension element is provided at the second shutter that is pre-stressed in the operating position of the second shutter and supports the opening movement thereof into the open position due to the pre-stressing force.

In the invention, the shutters swivelled in common into the open position release an opening through which the sheets jammed in the paper path can be removed in a simple and comfortable way. Further, the opening of the shutters is facilitated by the tension element that promotes the opening movement of the second shutter. When, by contrast, the second shutter is swivelled into the operating position, it is mechanically clamped by the pre-stressing force exerted by the tension element and is held in a defined position in this way.

It is fundamentally possible to equip each of the two shutters with a separate lock and with its own actuation means, that must be separately actuated for each shutter. According to a development of the invention, however, it is advantageous that the second shutter is pivotable by the actuation means together with the first shutter, so that operation is simple and takes little time.

It would then be possible to provide a higher-ranking actuation and locking means that, for example, is connected to each of the two shutters via a rodding. An especially simple and expedient development of the invention is then comprised therein that the second shutter is fashioned and trainable by the first shutter.

The first swivelling axis can be displaceably arranged on, for instance, a pivotably seated carrier, so that the first shutter can be swivelled around obstacles in this way.

In a preferred embodiment, the first swivelling axis is stationarily arranged at the single sheet printer. In order to be able to pivot the first shutter around an obstacle, it potentially has a projecting web at the backside, i.e., at the side facing away from the paper path, whose free end edge is penetrated by the swivelling axis.

It is also proposed to seat the second shutter pivotably at the first shutter and to provide a tension spring as a tension element that has its one end secured to the first shutter and has its other end secured to the second shutter, so that the second swivelling axis also swivels when the first shutter is swivelled. As a result of the tension spring, the two shutters are secured such that, in their operating position, it stresses these toward one another between their guide surfaces and the second swivelling axis. The movement of the second shutter in at least the one direction, namely when opening the shutters, can thus be controlled in a simple and dependable way.

In another preferred, second embodiment, the second swivelling axis is also stationarily arranged at the single sheet printer and a tension spring is provided as tension element that has its one end stationarily secured at the single sheet printer and has its other end secured to the second shutter. Two separate shutters are thus provided that, like window shutters, are hinged at both sides of the access opening of the paper path.

The shutters, for example, can be shaped of deep-drawn sheet metal or can be cast in one piece. According to a development of the invention, it is especially advantageous that the two shutters are parts of profiled ledges that extend transversely relative to the paper path.

Such profiled ledges can be manufactured of plastic or lightweight metal with high precision and surface quality in an economical way and are provided as desired with versatile stiffening means.

In a preferred embodiment of the invention, the actuation means is a locking rod seated in the first shutter and extending transversely relative to the paper path that engages into an abutment stationarily attached to the single sheet printer and comprises a draw-button for unlocking.

The first shutter is thus positively held in its respective locked position; the locking rod can be actuated from the outside of the mechanism of the single sheet printer via the draw-button. Given a correspondingly rigid shutter, it is adequate to lock this at only one side. A reliable holding of the shutter is achieved in a development of the invention in that an abutment is arranged at both sides of the first shutter.

In the first of the alternative embodiments recited above, a bearing plate is attached to the first shutter for improved stiffening of the profiled ledge and for bearing additional elements, this bearing plate extending transversely to the first shutter from the side facing away from the guide surface. At its side facing away from the guide surface, the second shutter comprises a projecting web at whose end the second swivelling axis is provided, whereby the second swivelling axis is connected to the projecting part of the bearing plate.

A rodding that sees to the motion control of the second shutter can be arranged between the first shutter that comprises the actuation means and the second shutter.

Since the first shutter is fixed in its operating position by locking the actuation means, the support of the second shutter in the operating position can ensue via the first shutter. Further, a stationary abutment is provided that supports the second shutter in its operating position. This sees to a stable and precise final position of the second shutter.

The abutment is advantageously composed of a stationary connecting link that is provided for accepting and for supporting a sliding pad that is attached to the second shutter. When swivelling the second shutter into the operating position, the sliding pad engages into the connecting link and supports the second shutter.

The connecting link is preferably arranged close to the end of the second shutter that faces away from the first shutter. The connecting link comprises two parallel guide webs that preferably extend parallel to the guide surface of the second shutter, whereby the guide web facing away from the second shutter is shortened such that the sliding pad can be pivoted out of the connecting link preceding this guide web when the two shutters are opened and runs up against the longer guide web when the shutters are closed and can be moved therefrom into the connecting link.

The limitation of the open limit position of the second shutter on the first could ensue with a catch, an interlock or a suitable arrangement of the tension spring. An especially simple and reliable embodiment, however, is comprised in providing a stop on the bearing plate. The second shutter is thereby pulled against the stop by the tension spring and thus dependably assumes its limit position.

In especially expedient arrangement of the aforementioned, second embodiment, wherein both shutters are respectively attached in a stationary pivot bearing at both sides of the opening, the second shutter comprises a projecting web at its back side which faces away from the first shutter and the second swivelling axis is connected to the free end of said projecting web, and that the second swivelling axis intersects a straight line proceeding through both ends of the tension spring in the open position of the second shutter. The tension spring thus holds the second shutter in its open position, so that an additional stop or an interlock for the second shutter is not required, even when it is released from engagement with the first shutter in its open position.

Only one stop which, however, must be controlled by the first shutter, is required in order to retain the second shutter in its operating position opposite the force of the tension spring. To this end, a continuation that engages behind the second shutter in the operating position is arranged on the first shutter, this continuation also holding the second shutter in its operating position when the first shutter is locked.

The continuation preferably not only serves to hold the second shutter closed, i.e., in its operating position, but is also lengthened such that it engages behind the second shutter when the first shutter is closed and thus entrains the second shutter into the closed operating position.

Only a single tension spring and a rigid continuation thus suffice in order to fully couple the second shutter with the first shutter in its closing and opening motion, whereby the dependability is enhanced due to the simple structure.

The continuation could, for example, be fashioned as a pin that is screwed into the profiled rod forming the first shutter. An especially simple but stable design is comprised therein that the continuation is fashioned at a plate that extends transversely relative to the first shutter and is attached to the backside thereof. The broad but thin-walled continuation of sheet metal that is loaded in a direction transversely relative to the thickness of its wall forms a lightweight, flexurally rigid element. The sheet metal also in turn stiffens the profiled rod that forms the first shutter.

The continuation can engage behind a second sliding pad that is fashioned at the second shutter. It is also possible to fashion the second shutter longer than the first, so that the continuation engages behind the second shutter.

A preferred development of the invention is comprised therein that the continuation attacks at the articulation of the tension spring and is arranged laterally next to the second shutter or opposite a slot therein, so that the pivot paths of the second shutter and of the continuation can overlap. All forces applied onto the second shutter are thus introduced into the tension spring articulation. The second shutter itself remains essentially unloaded and can thus be implemented light.

In an embodiment, the present invention provides a shutter assembly for a paper path of a single sheet printing or copying device, the shutter assembly comprising a first shutter pivotably mounted to the device about a first axis, the first shutter comprising a first guide surface for the paper path when the first shutter is in a first operating position, the first shutter being pivotable to a first open position wherein the first guide surface is clear of the paper path, the first shutter being connected to a locking rod which releasably engages the device for locking the first shutter in the first operating position, the shutter assembly also comprising a second shutter pivotably mounted to the device about a second axis, the second shutter comprising a second guide surface for the paper path that is in alignment with the first guide surface of the first shutter when the second shutter is in a second operating position, the second shutter being pivotable between the second operating position and a second open position wherein the second guide surface of the second shutter is clear of the paper path, the second shutter being connected to at least one tension element that biases the second shutter towards the second open position, the first shutter engaging the second shutter when the first shutter is in the first operating position and the first shutter effectively locking the second shutter in the second operating position when the first shutter is locked into the first operating position by the locking rod.

In an embodiment, movement of the first shutter to the first open position results in movement of the second shutter to the second open position.

In an embodiment, movement of the first shutter to the first operating position results in movement of the second shutter to the second operating position.

In an embodiment, the first axis comprises a pin that is stationarily connected to the device.

In an embodiment, the second shutter is pivotably connected to the first shutter at the second axis, and the tension element comprises a tension spring with one end connected to the first shutter and a second end connected to the second shutter.

In an embodiment, the second axis comprises a pin stationarily connected to the device, and the tension element comprises a tension spring with one end connected to the device and another end connected to the second shutter.

In an embodiment, the first and second guide surfaces of the first and second shutters extend transversely relative to the paper path.

In an embodiment, the locking rod extends transversely relative to the paper path, the locking rod engaging two abutments connected to the device at opposing sides of the first shutter, the locking rod comprising a draw-button at one end for unlocking the locking rod from one of said abutments.

In an embodiment, the first shutter is connected to a bearing plate, the bearing plate extending away from the paper path and towards the second shutter, the second shutter comprising a projecting web that extends away form the paper path, the second axis extending through the projecting web, the second axis passing through the bearing plate.

In an embodiment, the second shutter engages a stationary abutment when the second shutter is in the second operating position.

In an embodiment, the second shutter comprises a sliding pad and the abutment comprises a stationary connecting link configured for receiving the sliding pad when the second shutter moves into the second operating position.

In an embodiment, the bearing plate comprises a stop, the stop projecting into a path of the second shutter as the second shutter moves from the second operating position to the second open position, the stop engaging the second shutter and limiting movement thereof when the second shutter reaches the second open position.

In an embodiment, the second shutter comprises a projecting web that extends away from the paper path and the first shutter, the projecting web comprising a free end of said web through which the second axis extends, and in the second open position of the second shutter, a straight line proceeding through the two ends of the tension spring intersects the second swivelling axis.

In an embodiment, the first shutter comprises a continuation member that engages the second shutter when the first and second shutters are in the first and second operating positions respectively, the continuation member holding the second shutter in its second operating position when the first shutter is locked in its first operating position.

In an embodiment, the continuation element engages the second shutter as the first shutter is moved from the first open position to the first operating position thereby moving the second shutter into the second operating position.

In an embodiment, the continuation member comprises a plate that extends transversely relative to the first shutter, the first shutter comprising a backside, the continuation member being connected to the backside.

In an embodiment, the continuation member engages the tension spring and is disposed laterally adjacent to the second shutter so that, during movement of the first shutter from the first open position to the first operating position, the continuation member engages the second shutter.

The invention is not limited to the exemplary embodiments recited above and to an arrangement having two shutters. For example, each shutter can be actuated and locked separately, and more than two shutters can be provided. For example, it would be possible to arrange two shutters at both sides of an opening, at least one thereof being in turn composed of two shutters as described in the above explanation.

Other objects and advantages of the present invention will become apparent from reading the following detailed description and appended claims, and upon reference to the accompanying drawings.

BRIEF DESCRIPTION OF THE DRAWINGS

The invention is explained in detail below on the basis of preferred exemplary embodiments with reference to the drawings, wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
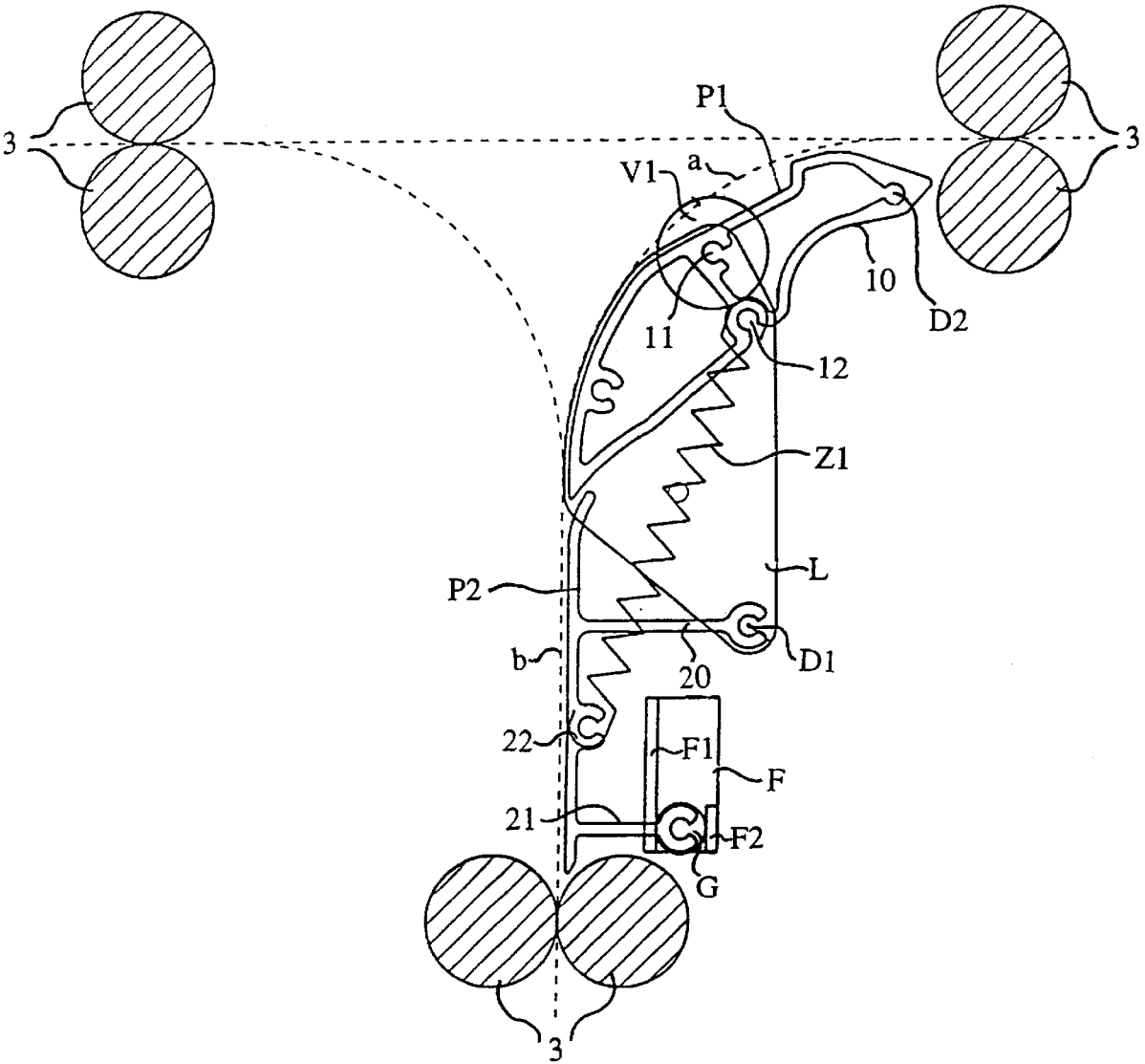
FIG. 1 is a schematic longitudinal view of a first embodiment of the inventive shutter arrangement, in its operating position.
Figure 2:
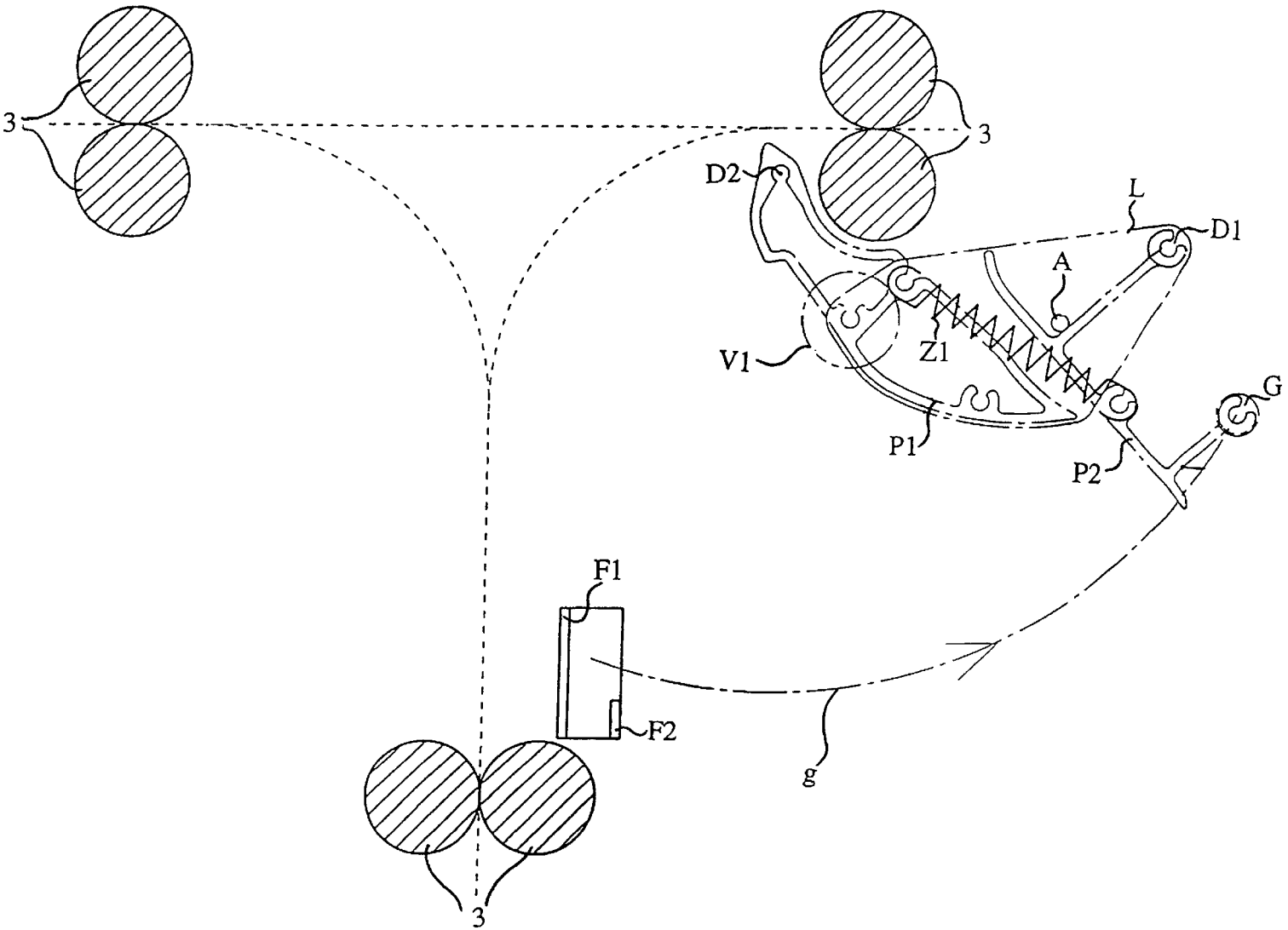
FIG. 2 illustrates the shutter arrangement of FIG. 1 in the open position.
Figure 3:
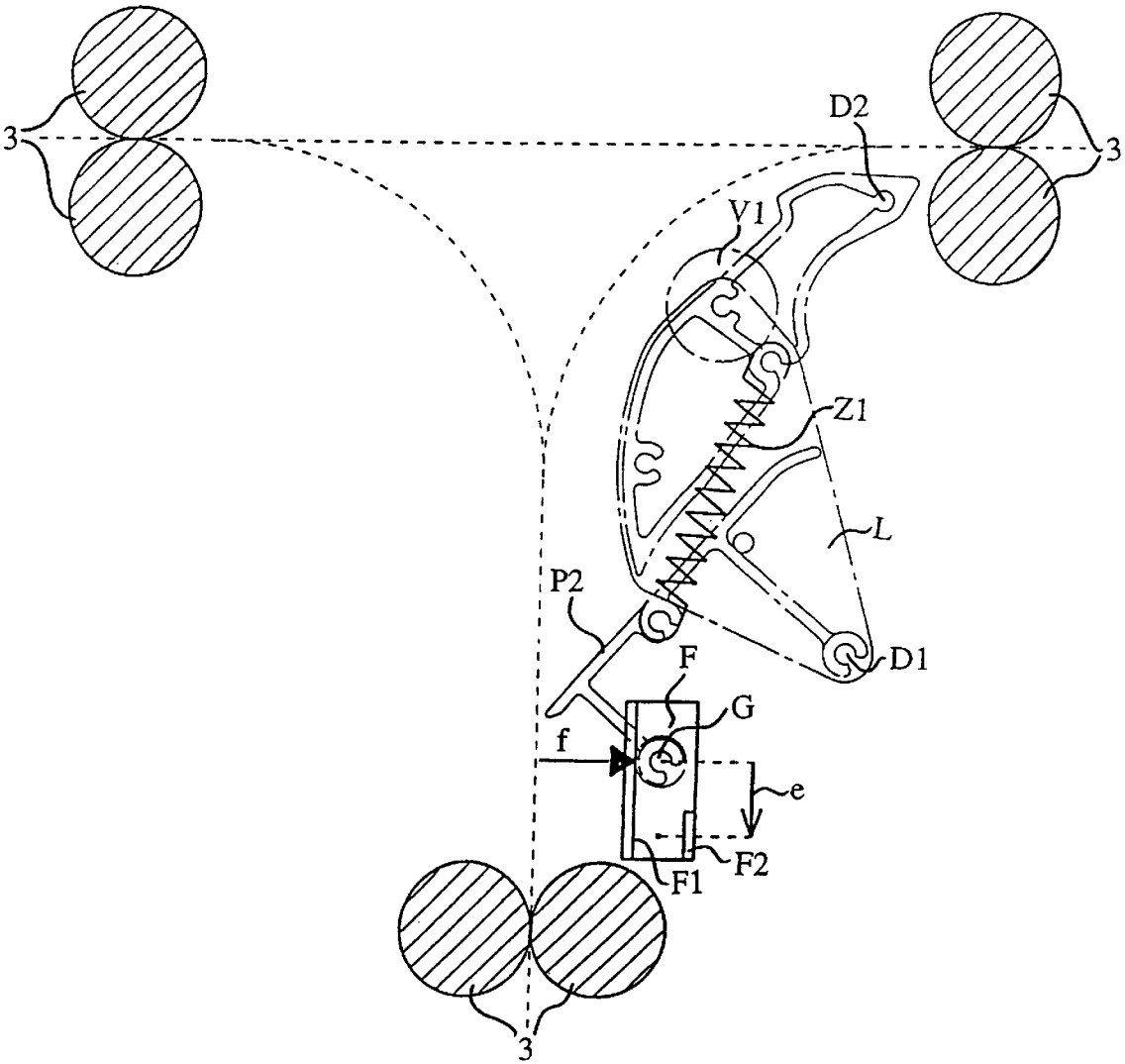
FIG. 3 illustrates the shutter arrangement of FIG. 1 during opening or closing.

Reference characters that are entered into one of the respectively three FIGS. 1 through 3 or, respectively, 4 through 6 are respectively correspondingly valid for all three figures.

FIG. 1 shows a plurality of paper paths in a side view as broken lines, these being limited by clamp or, respectively, conveyor rollers 3. The paper paths are limited by guide surfaces for the individual sheets; these guide surfaces are not shown here with the exception of an arcuate section, whereby the guide surface is formed by the outside surface of two shutters P1, and P2 adjoining one another when they are in the operating position shown in FIG. 1. The two shutters P1 and P2 are located between clamp roller pairs 3 or the paper path.

Both shutters P1, and P2 are formed of a profiled rod that respectively extends transversely relative to the paper path. The first profiled rod P1 is formed of a hollow profile that is formed by the outside wall adjoining the paper path having an arcuate cross section, an inside wall connecting its two ends tendon-like and of a stiffening portion that connects the approximate center points of the outside wall and the inside wall to one another. Close to the first pivot point, also referred to as a first swivelling axis, D2, the inside wall thereby comprises a flat gutter 10 with which it embraces the neighboring clamp roller in the open position (FIG. 2).

A first swivelling axis D2 extends along the first shutter P1 at the intersection of the inside wall and the outside wall that lies closest the one clamp roller pair. At the location of the swivelling axis, the profiled rod forming the first shutter P1 comprises a bore similar to a profiled section into which pivot pegs can be inserted at the ends of the profiled rod, these pivot pegs being accepted in stationary bearings of the single sheet printer (not shown).

A further fashioning 11 of the profiled rod similar to a bore is located at the junction of outside wall and stiffening. This configuration is penetrated by a locking rod V1 that comprises an actuation knob at at least one end of the first shutter P1, this serving the purpose—by being pulled or pushed in—of moving the locking rod V1 in its longitudinal direction (in the profiled direction of the first shutter P1) such that it is released from the mounts (not shown) that are stationarily arranged at both sides of the first shutter. In its quiescent position, the locking rod V1 holds the first shutter P1 locked in the operating position shown in FIG. 1.

At one or both ends of the first shutter P1, a bearing plate L is put in place thereon that provides the stiffening as well as the part of the profile that faces away from the first swivelling axis D2. The bearing plate extends far beyond the inside wall of the profile and forms a triangular leg whose tip pointing away from the first shutter P1 is penetrated by a second swivelling axis D1, and whereby a stop A (FIG. 2) that projects at the side of the bearing plate L facing toward the first shutter P1 is arranged in the middle thereof.

A spring articulation 12 that has its end projecting beyond the first shutter P1 and the bearing plate L is located at the junction of the inside wall and the stiffening.

The outside wall of the first shutter P1 adjoins at an arcuate section a of the paper path that is followed by a straight section b at which a wall of a second shutter P2 adjoins. At its edge facing toward the first shutter P1, this wall is bent away from the paper path and overlaps that side of the first shutter P1 facing toward the paper path thereat.

At the backside of the second shutter P2, distanced from its curved edge by about one-third of its length (that proceeds in conveying direction of the paper sheet), a first web 20 extending in the profile direction thereof projects therefrom, this exhibiting a length that corresponds to nearly half the length of the shutter.

A thickened portion having an interior similar to a bore is fashioned at the free edge of the first web, a second swivelling axis D1 that lies on an imaginary line between the swivelling axis D2 and a sliding pad G proceeding therethrough. This thickened portion is overlapped at both ends by the tip of the bearing plate L of the first shutter P1; a pivot peg respectively secured to this bearing plate L extends into the interior of the thickened portion.

A second web 21 whose free edge is fashioned just like that of the first web projects from the backside of the shutter close to the edge of the second shutter P2 that lies opposite the curved edge. The cylindrical sliding pad G that extends in the profiled direction is respectively secured to the ends of this free edge.

A respective spring articulation 22 is fashioned at the end at the backside of the wall of the second shutter P2 approximately in the middle between the two webs 20 and 21. A tension spring Z1 extends at each of the ends of the two shutters P1 and P2 between the two spring articulations 12 and 22 of the two shutters P1 and P2.

A stationary guide F like a connecting link is arranged at one side of the second shutter P2 and has a long guide web F1 parallel to the neighboring paper path and a short guide web F2 that is arranged at the side of the long guide web F1 remote from the paper path and parallel thereto. The distance between the two guide webs F1 and F2 is dimensioned such that the sliding pad G is displaceably guided between these and practically free of play.

In the operating position of FIG. 1, the sliding pad G is seated between the two guide webs F1 and F2, so that the second shutter P2 is retained, first, by the guide F and, second, by the second swiveling axis D1 that is in turn fixed in place because the locking rod V1 retains the first shutter P1 in its operating position.

When the locking rod V1 is released and when the first shutter P1 is opened up with its manipulation (counterclockwise in FIG. 1), the swivelling axis D1 moves away from the paper path b and entrains the second shutter P2. As can be seen from FIG. 3, this is stressed such by the tension spring Z1 that it is pivoted around the swivelling axis D1 in a clockwise direction, whereby the sliding pad G is pressed against the guide web F1 of the guide F until the second shutter P1 has its first web 20 lying against the stop A FIG. 2). This intermediate position is shown in FIG. 3 wherein the arrow f illustrates the pressing power of the sliding pad G against the guide web F1.

The sliding pad G has thereby moved along the guide web F1 by the length of the arrow e in the meantime and has thereby emerged from the engagement region of the retaining web F2. When the swivel motion of the locking rod V1 is then continued, the open position shown in FIG. 2 is ultimately achieved, whereby the sliding pad G traverses the motion path g shown dot-dashed.

In this open position, the locking rod V1 can again be locked at the single sheet printer, so that the shutter arrangement remains in the open position shown in FIG. 2.

When being closed, the sliding pad G strikes against the guide web F1 of the guide F and subsequently moved there along until it proceeds into the interspace between guide web F1 and retaining web F2. The first shutter P1 is then locked with the locking rod V1 and holds it fast in collaboration with the guide F. That edge of the second shutter P2 remote from the first shutter P1 thereby engages into the draw-in region between the adjoining clamp rollers of the paper path. Only the inventive arrangement composed of the two shutters P1 and P2 can produce an opening having such a great width that facilitates access to the paper path, since the second shutter P2 is first pivoted out of its operating position toward the first shutter P1 before it is completely pivoted away from the paper path together with the first shutter P1.

Figure 4:
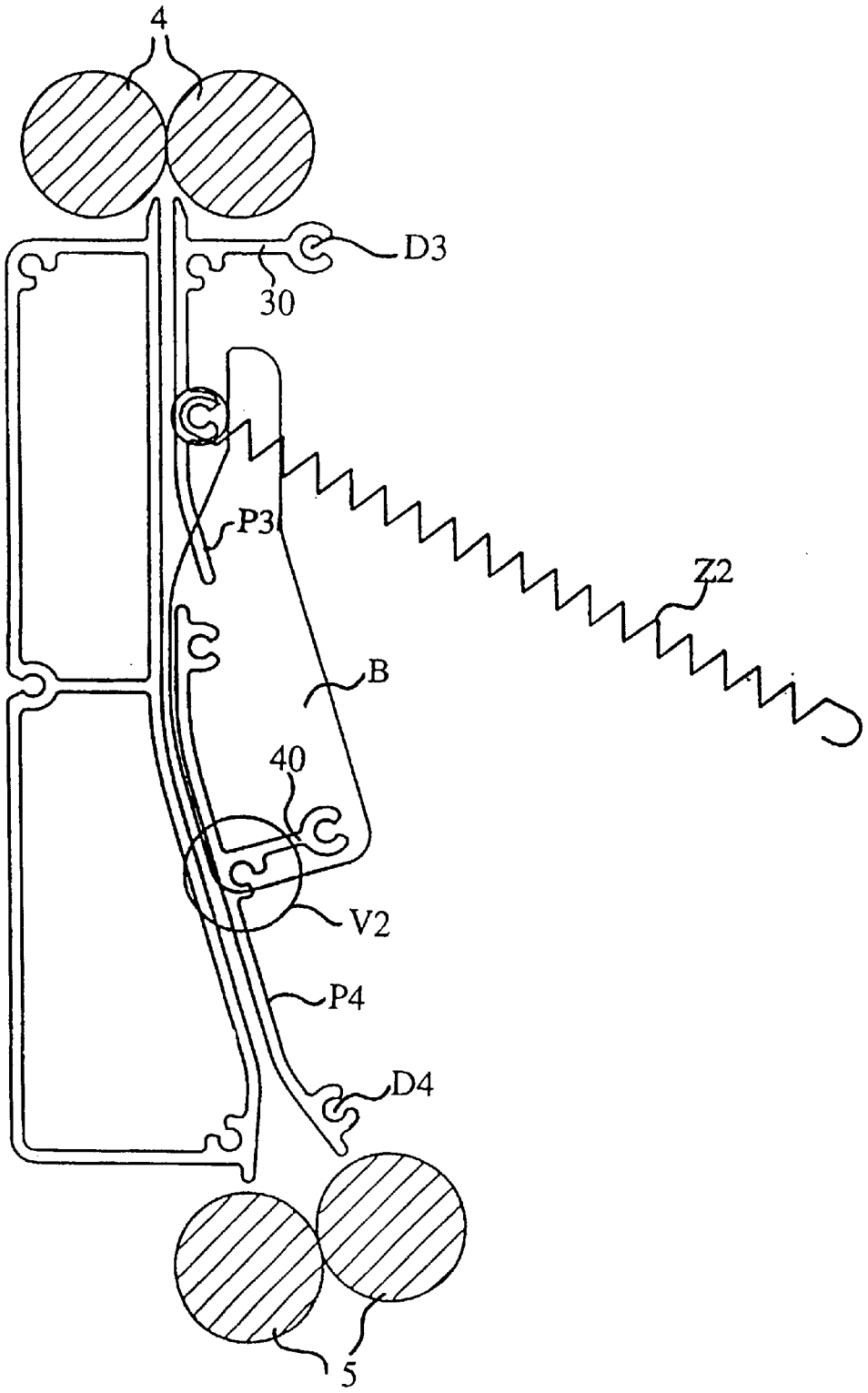
FIG. 4 is a schematic longitudinal view of a second embodiment of the inventive shutter arrangement, in operating position.
Figure 5:
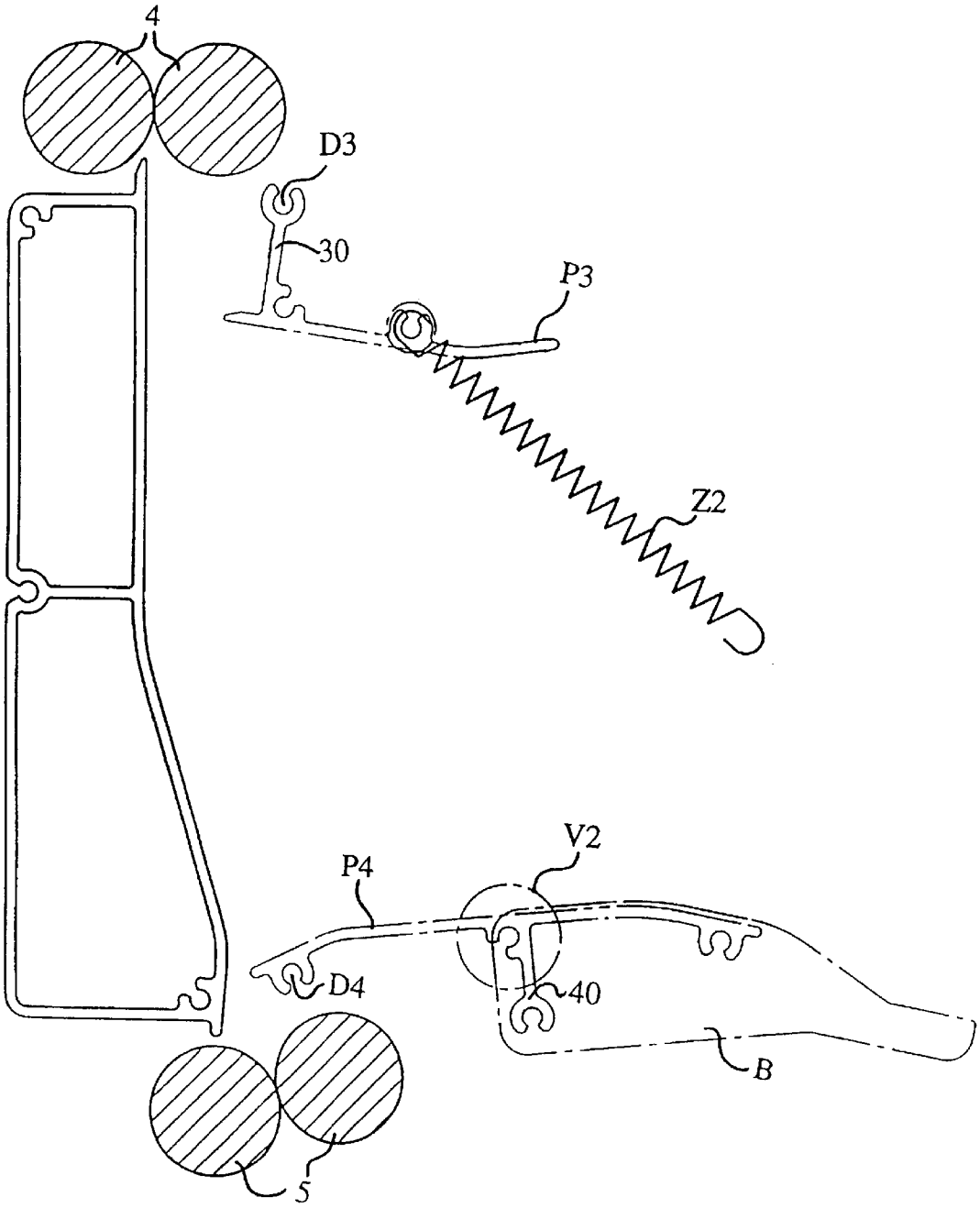
FIG. 5 illustrates the shutter arrangement of FIG. 4 in open position.
Figure 6:
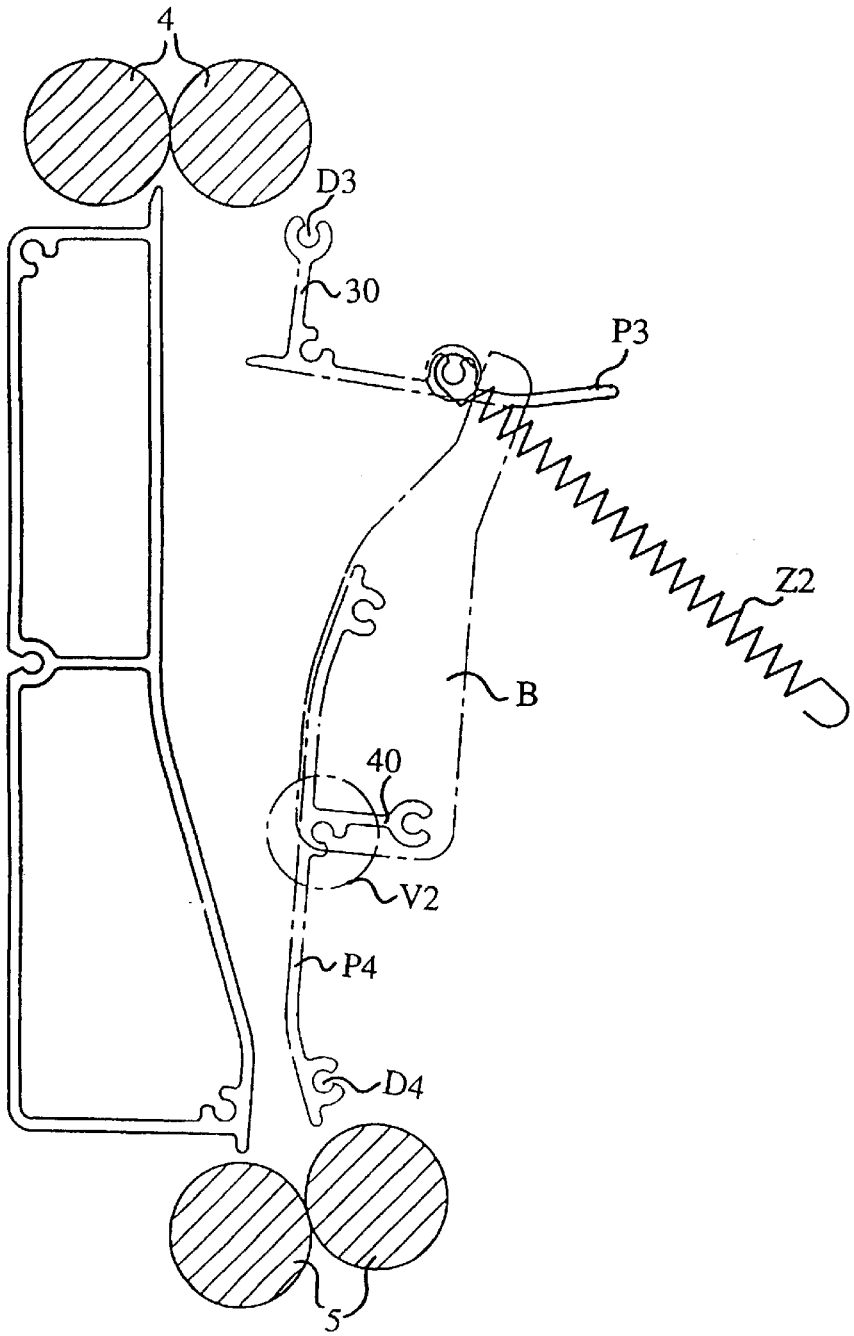
FIG. 6 illustrates the shutter arrangement of FIG. 4 during opening or closing.

FIGS. 4 through 6 show a second embodiment of the shutter arrangement that is attached to a paper path limited by two clamp roller pairs 4 and 5 and slightly angled off roughly in the middle between these.

The paper path is limited by two shutters P4 and P3 in their operating position, both of these shutters P1 and P2, as described above, being composed of profiled rods that extend transversely relative to the paper web.

The first shutter P4 comprises a wall that is adapted to the course of the paper web and extends from the first clamp roller pair 5 to beyond the middle of the distance to the second clamp roller pair 4. The lateral edge of the first shutter P4 that faces toward the first clamp roller pair 5 is curved slightly away from the paper path in order to facilitate the entry of the paper web at this location.

A fashioning with an interior similar to a bore is located at the backside of the wall (the side facing away from the paper path) close to the edge that is curved away, a first swivelling axis D4 with which the first shutter P4 is pivotably attached to the single sheet printer extending through this interior.

A similar fashioning is attached in the middle between the two edges of the first shutter P4 and accepts a locking rod V2 whose structure and functioning correspond to the above-described locking rod V1 of the first embodiment and that, like the other, releasably locks the first shutter P4 in the operating position shown in FIG. 4.

Further, a fashioning with an interior similar to a bore is respectively formed at that edge of the first shutter P4 facing toward the second shutter P3 and at the free end edge of a web 40 that, for reinforcing purposes, is attached to the backside of the wall of the first shutter P4 close to the receptacle of the locking rod V2 and projects from the wall at a right angle.

A plate B is respectively attached at both sides at the end sides of the first shutter P4, the plate B being carried by the web 40 and by the part of the wall facing toward the second shutter P3 and comprising a finger projecting far in the direction of the second shutter P3 that engages far behind the second shutter P3.

The second shutter P3 comprises a wall that extends up to a point between the two first clamp rollers 4 and comprises a spring articulation at its backside roughly in the middle between the two edges as well as guide pin. The guide pin is seated in a bore and carries a web 30 projecting from the backside (the side facing away from the paper path) close to the first clamp rollers. At its free end edge, the web 30 has a thickened portion through whose interior the second swivelling axis D3 proceeds, the second shutter P3 being rotatably attached to the single sheet printer therewith.

The edge of the wall facing toward the first shutter P4 does not extend entirely up to the first shutter P4 and is curved slightly away from the paper web.

A tension spring Z2 has its one end hinged to the spring articulation of the second shutter P3 and has its other end hinged to a stationary point of the single sheet printer. This point lies opposite the middle of the paper path covered by the two shutters P4 and P3 spaced therefrom such that the track of the second swivelling axis D3 and the two hinge points of the tension spring Z2 lie on a straight line in the side view of FIG. 5.

In the operating position of FIG. 4, the first shutter P4 is retained by the locking rod V2, has the finger of the plate B engaging behind the guide pin of the second shutter P3 and thereby holds this in its operating position, even though a tensile force for opening acts on the second shutter P3 as a result of the tension spring Z2.

When the locking rod V2 is unlocked and when the first shutter P3 is pivoted into its open position (FIG. 5) with the handle attached to it, then the first shutter P3 is again locked in this open position with the locking rod V2. The second shutter P4 is then released by the finger, is swivelled by the tension of the tension spring Z2 and is held in the open position by this.

When the first shutter P4 in the open position is released by actuating the locking rod V2 and pivoted in, the finger becomes seated at the guide pin at the second shutter P3 and presses this in the direction toward the paper path as shown in FIG. 6. Since this load ensues offset relative to the second swivelling axis D3, the guide pin yields and thereby runs along that edge of the finger adjacent to it, whereby it pivots the second shutter P3 until the shutters P4 and P3 have reached the operating position of FIG. 4.

In both embodiments, the profiled rods that form the shutters P1 and P4 can be manufactured of plastic or metal, preferably of an aluminum alloy. The bearing plates L and plates B are attached to the two ends of the profiled rods at one side, these profiled rods forming the first shutters P1 and P4.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A shutter assembly for a paper path of a single sheet printing or copying device, the shutter assembly comprising:

a first shutter pivotably mounted to the device about a first axis, the first shutter including a first guide surface for the paper path when the first shutter is in a first operating position, the first shutter being pivotable to a first open position wherein the first guide surface is clear of the paper path, the first shutter being connected to a locking rod which releasably engages the device for locking the first shutter in the first operating position;

a second shutter pivotably mounted to the device about a second axis, the second shutter including a second guide surface for the payper path that is in alignment with the first guide surface of the first shutter when the second shutter is in a second operating position, the second shutter being pivotable between the second operating position and a second open position wherein the second guide surface of the second shutter is clear of the paper path;

at least one tension element connected to the second shutter that biases the second shutter towards the second open position;

the first shutter engaging the second shutter when the first shutter is in the first operating position and the first shutter effectively locking the second shutter in the second operating position when the first shutter is locked into the first operating position by the locking rod;

the second shutter being pivotably connected to the first shutter at the second axis, and the tension element including a tension spring with one end connected to the first shutter and a second end connected to the second shutter.

2. The shutter assembly of claim 1, wherein movement of the first shutter to the first open position results in movement of the second shutter to the second open position.

3. The shutter assembly of claim 2, wherein movement of the first shutter to the first operating position results in movement of the second shutter to the second operating position.

4. The shutter assembly of claim 1, wherein the first axis includes a pin that is stationarily connected to the device.

5. The shutter assembly of claim 1, wherein the first and second guide surfaces of the first and second shutters extend transversely relative to the paper path.

6. The shutter assembly of claim 1, wherein the first shutter is connected to a bearing plate, the bearing plate extending away from the paper path and towards the second shutter, the second shutter including a projecting web that extends way form the paper path, the second axis extending through the projecting web, the second axis passing through the bearing plate.

7. The shutter assembly of claim 6, wherein the second shutter engages a stationary abutment when the second shutter is in the second operating position.

8. The shutter assembly of claim 7, wherein the second shutter includes a sliding pad and the abutment includes a stationary connecting link configured for receiving the sliding pad when the second shutter moves into the second operating position.

9. The shutter assembly of claim 6, wherein the bearing plate includes a stop, the stop projecting into a path of the second shutter as the second shutter moves from the second operating position to the second open position, the stop engaging the second shutter and limiting movement thereof when the second shutter reaches the second open position.

10. A shutter assembly for a paper path of a single sheet printing or copying device, the shutter assembly comprising:

a first shutter pivotably mounted to the device about a first axis the first shutter including a first guide surface for the paper path when the first shutter is in a first operating position, the first shutter being pivotable to a first open position wherein the first guide surface is clear of the paper path, the first shutter being connected to a locking rod which releasably engages the device for locking the first shutter in the first operating position;

a second shutter pivotably mounted to the device about a second axis, the second shutter including a second guide surface for the paper path that is in alignment with the first guide surface of the first shutter when the second shutter is in a second operating position, the second shutter being pivotable between the second operating position and a second open position wherein the second guide surface of the second shutter is clear of the paper path;

at least one tension element connected to the second shutter that biases the second shutter towards the second open position;

the first shutter engaging the second shutter when the first shutter is in the first operating position and the first shutter effectively locking the second shutter in the second operating position when the first shutter is locked into the first operating position by the locking rod;

the second axis including a pin stationarily connected to the device, and the tension element including a tension spring with one end connected to the device and another end connected to the second shutter.

11. the shutter assembly of claim 10, wherein the second shutter includes a projecting web that extends away from the paper path and the first shutter, the projecting web including a free end of said web through which the second axis extends; and in the second open position of the second shutter, a straight line proceeding through the two ends of the tension spring intersects the second axis.

12. The shutter assembly of claim 11, wherein the first shutter including a continuation member that engages the second shutter when the first and second shutters are in the first and second operating positions respectively, the continuation member holding the second shutter in its second operating position when the first shutter is locked in its first operating position.

13. The shutter assembly of claim 12, wherein the continuation element engages the second shutter as the first shutter is moved from the first open position to the first operating position thereby moving the second shutter into the second operating position.

14. The shutter assembly of claim 13, wherein the continuation member includes a plate that extends transversely relative to the first shutter, the first shutter having a backside, the continuation member being connected to the backside.

15. The shutter assembly of claim 14, wherein the continuation member engages the tension spring and is disposed laterally adjacent to the second shutter so that, during movement of the first shutter from the first open position to the first operating position, the continuation member engaging the second shutter.

16. The shutter assembly of claim 10, wherein movement of the first shutter to the first open position results in movement of the second shutter to the second open position.

17. The shutter assembly of claim 16, wherein movement of the first shutter to the first operating position results in movement of the second shutter to the second operating position.

18. The shutter assembly of claim 10, wherein the first axis includes a pin that is stationarily connected to the device.

19. The shutter assembly of claim 10, wherein the first and second guide surfaces of the first and second shutters extend transversely relative to the paper path.

20. A shutter assembly for a paper path of a single sheet printing or copying device the shutter assembly comprising:

a first shutter pivotably mounted to the device about a first axis the first shutter including a first guide surface for the paper path when the first shutter is in a first operating position, the first shutter being pivotable to a first open position wherein the first guide surface is clear of the paper path the first shutter being connected to a locking rod which releasably engages the device for locking the first shutter in the first operating position;

a second shutter pivotably mounted to the device about a second axis, the second shutter including a second guide surface for the paper path that is in alignment with the first guide surface of the first shutter when the second shutter is in a second operating position, the second shutter being pivotable between the second operating position and a second open position wherein the second guide surface of the second shutter is clear of the paper path;

at least one tension element connected to the second shutter that biases the second shutter towards the second open position;

the first shutter engaging the second shutter when the first shutter is in the first operating position and the first shutter effectively locking the second shutter in the second operating position when the first shutter is locked into the first operating position by the locking rod; and the locking rod extending transversely relative to the paper path, the locking rod engaging two abutments connected to the device at opposing sides of the first shutter, the locking rod including a draw-button at one end for unlocking the locking rod from one of said abutments.

* * * * *